US007731349B2

(12) United States Patent
Hatasa et al.

(10) Patent No.: US 7,731,349 B2
(45) Date of Patent: Jun. 8, 2010

(54) PRINTING MACHINE

(75) Inventors: Kazuhiro Hatasa, Kasugai (JP); Syunji Kato, Kasugai (JP); Hiroshi Yamazaki, Kasugai (JP); Shunichi Ihara, Kasugai (JP)

(73) Assignee: Kabushiki Kaisha Isowa (JP)

( * ) Notice: Subject to any disclaimer, the term of this patent is extended or adjusted under 35 U.S.C. 154(b) by 280 days.

(21) Appl. No.: 11/447,798

(22) Filed: Jun. 6, 2006

(65) Prior Publication Data

US 2006/0279752 A1 Dec. 14, 2006

(30) Foreign Application Priority Data

Jun. 10, 2005 (JP) ..... 2005-171320

(51) Int. Cl.
*B41J 2/01* (2006.01)

(52) U.S. Cl. ..... 347/104; 347/34

(58) Field of Classification Search ..... 347/28–34, 347/104

See application file for complete search history.

(56) References Cited

U.S. PATENT DOCUMENTS

| | | | | |
|---|---|---|---|---|
| 3,189,502 | A | 6/1965 | Little | |
| 3,493,122 | A | 2/1970 | McKee | |
| 3,741,117 | A | 6/1973 | Bienert et al. | |
| 4,059,220 | A | 11/1977 | Lorenz | |
| 4,339,292 | A | 7/1982 | Itoh et al. | |
| 4,792,249 | A | 12/1988 | Lahr | |
| 5,037,079 | A | 8/1991 | Siegel et al. | |
| 5,428,375 | A | 6/1995 | Simon et al. | |
| 5,528,271 | A * | 6/1996 | Ebisawa | 347/34 |
| 5,906,156 | A | 5/1999 | Shibuya et al. | |

(Continued)

FOREIGN PATENT DOCUMENTS

DE 44 25 199 A1 1/1996

(Continued)

OTHER PUBLICATIONS

European Search Report dated Nov. 28, 2006.

(Continued)

*Primary Examiner*—Manish S Shah
(74) *Attorney, Agent, or Firm*—Brinks Hofer Gilson & Lione

(57) ABSTRACT

A printing machine includes a transfer device including a conveyor having suction holes formed therethrough for transferring cardboard sheets one by one, a suction device for applying a suction force on one of the two surfaces of each of the cardboard sheets, which one of two surfaces faces the conveyor, and ink jet heads located to face the other of the surfaces of each of the cardboard sheets to be spaced apart therefrom. The ink jet heads are located in such a manner that a desired distance is maintained between tips of the ink jet heads and the other surface to be printed and include ink jet nozzles from each of which ink is jetted out toward said the other surface. The ink jet heads have skirts located upstream and downstream of the transferring direction of the cardboard sheets in such a manner that the skirts extend from the ink jet heads toward the other surface and have a width which covers the ink jet nozzles so as to form a partition in a space between the ink jet nozzles and the other surface.

5 Claims, 7 Drawing Sheets

U.S. PATENT DOCUMENTS

| | | | | |
|---|---|---|---|---|
| 5,992,994 | A * | 11/1999 | Rasmussen et al. | 347/104 |
| 6,079,617 | A | 6/2000 | Kim | |
| 6,467,410 | B1 | 10/2002 | Rasmussen et al. | |
| 6,563,527 | B1 | 5/2003 | Shimoda et al. | |
| 6,755,505 | B2 * | 6/2004 | Liu et al. | 347/37 |
| 6,981,756 | B2 * | 1/2006 | Fredrickson et al. | 347/34 |
| 2002/0018097 | A1 | 2/2002 | Kitahara et al. | |
| 2002/0062750 | A1 | 5/2002 | Wotton et al. | |
| 2002/0113981 | A1 | 8/2002 | Nakajima | |
| 2002/0167578 | A1 | 11/2002 | Miki et al. | |
| 2003/0016269 | A1 | 1/2003 | Sekiya | |
| 2003/0105665 | A1 | 6/2003 | Jankovic | |
| 2004/0017456 | A1 | 1/2004 | Obertegger et al. | |
| 2004/0066441 | A1 | 4/2004 | Jones et al. | |
| 2004/0182503 | A1 | 9/2004 | Stadele | |
| 2006/0284953 | A1 | 12/2006 | Hatasa et al. | |
| 2007/0247505 | A1 * | 10/2007 | Isowa et al. | 347/101 |

FOREIGN PATENT DOCUMENTS

| | | | |
|---|---|---|---|
| DE | 10 2004 029 037 | A1 | 12/2005 |
| EP | 0 554 989 | A1 | 8/1993 |
| EP | 1 459 878 | A2 | 3/2004 |
| EP | 1 449 669 | A1 | 8/2004 |
| EP | 1 731 318 | A2 | 12/2006 |
| GB | 2 343 415 | A | 5/2000 |
| JP | 07-068758 | | 3/1995 |
| JP | 2003231244 | | 8/2003 |
| JP | 2005-074763 | | 3/2005 |

OTHER PUBLICATIONS

European Search Report dated Sep. 6, 2006.

Dec. 26, 2007 Non-Final Office Action, U.S. Appl. No. 11/447,798 (8 pages).

Response to Dec. 26, 2007 Non-Final Office Action, U.S. Appl. No. 11/447,798 filed in the PTO on Jun. 18, 2008 (7 pages).

Oct. 1, 2008 Non-Final Office Action, U.S. Appl. No. 11/448,508 (16 pages).

Response to Oct. 1, 2008 Non-Final Office Action U.S. Appl. No. 11/448,508 filed in the PTO on Mar. 25, 2009 (4 pages).

Oct. 14, 2008 Non-Final Office Action, U.S. Appl. No. 11/447,798 (7 pages).

Response to Oct. 14, 2008 Non-Final Office Action, U.S. Appl. No. 11/447,798 filed in the PTO on Mar. 25, 2009 (3 pages).

Supplemental Response to Oct. 14, 2008 Non-Final Office Action, U.S. Appl. No. 11/447,798 filed in the PTO on Apr. 8, 2009 (4 pages).

Jun. 30, 2009 Non-Final Office Action, U.S. Appl. No. 11/448,508 (8 pages).

Sep. 22, 2009 Non-Final Office Action, U.S. Appl. No. 11/787,628 (20 pages).

Jul. 21, 2009 Non-Final Office Action, U.S. Appl. No. 11/409,551 (44 pages).

Response to Jul. 21, 2009 Non-Final Office Action, U.S. Appl. No. 11/409,551 filed in the PTO on Oct. 27, 2009 (15 pages).

Extended European Search Report from EPO application No. 07106579.1-2308 dated Jun. 5, 2007 (6 pages).

International Search Report from EPO application No. 07106574.2 dated May 8, 2008 (6 pages).

* cited by examiner

PRINTING MACHINE

This application claims the benefit of priority to Japanese patent application 2005-171320, filed on Jun. 10, 2005, which is incorporated herein by reference.

BACKGROUND OF THE INVENTION

The present invention relates to an ink-jet type printing machine, more particularly, a printing machine for printing a clear printing image on surfaces of cardboard sheets.

Japanese Patent document No. H03-121853A discloses an ink-jet type printing machine for cardboard sheets. This printing machine has a transfer device having a conveyor having suction holes for transferring the cardboard sheets one by one, a suction device for sucking one of two surfaces of each of the cardboard sheets, which faces the conveyor, through the suction holes, and ink jet heads spaced apart from the other of the two surfaces to be printed, the ink jet heads being located at the side of the other of the two surfaces to be spaced apart therefrom. The ink jet heads have ink jet nozzles and are located so as to maintain a desired distance between tips of the ink jet heads and the printing surface.

In accordance with above described constructions, the cardboard sheets are suctioned toward the conveyor via suction holes of the suction device and cardboard sheets are conveyed by the conveyor. When the cardboard sheets move across the ink jet heads, the ink droplets are jetted out toward the printing surface and land on the printing surface, whereby a printing image can be created.

However, the prior art printing machine has the following technical drawbacks.

It is important that the cardboard sheets are suctioned toward the conveyor by the suction device in order to prevent warp of the cardboard sheet or shifting of the cardboard sheets relative to the conveyor. At this time, a gap can be formed between adjacent sheets in the feeding direction because the sheets are transferred one by one. Since the holes on the gap portion is not covered with the cardboard sheet, suction air from the suction device is released through the gaps toward a space in which ink jet heads are disposed.

As a result, the environment between the ink jet heads and the printing surface will be disturbed, so that ink droplets are deflected before reaching the printing surface, and thus the deviation of the position of dots from the desired position can be caused, which causes unclear printing or even causes unsatisfactory printing result. However, because ink jet heads include a number of ink jet nozzles, it is almost impossible to adjust each of them in order to prevent such a deviation.

The object of the present invention is to provide an ink jet type printing machine which can print clear images on the desired position of an individual cardboard sheet.

SUMMARY OF THE INVENTION

One preferable embodiment of the printing machine according to the present invention comprises a transfer device including a conveyor having suction holes formed therethrough for transferring cardboard sheets one by one; a suction device for applying a suction force on one of the two surfaces of each of the cardboard sheets, which one of two surfaces faces said conveyor; ink jet heads located to face the other of the two surfaces of each of the cardboard sheets and be spaced apart therefrom; wherein said ink jet heads are located in such a manner that a desired distance is maintained between tips of the ink jet heads and said the other surface to be printed, and which ink jet heads include ink jet nozzles from each of which ink droplets are jetted out toward said the other surface; wherein the printing machine is characterized by the fact that: said ink jet heads have skirts located upstream and downstream of the transferring direction of the cardboard sheets in such a manner that said skirts extend from said ink jet heads toward said the other surface and have a width which covers said ink jet nozzles so as to form a partition in a space between said ink jet nozzles and said the other surface.

According to said arrangement described above, the cardboard sheets are transferred one by one by a transfer device toward the ink jet heads, while at the same time the cardboard sheets are sucked by the suction device toward the transfer device through its suction holes and thus a gap between the adjacent sheets in the transferring direction is formed. When the cardboard sheets pass through the ink jet heads, the ink jet nozzles are caused to emit ink droplets toward the surface of cardboard sheets and then land thereon without causing warp of the sheets and the shift of the sheets relative to the transfer device, and as a result, dots are formed on the sheet so that the desired printing images are created on the sheets.

At this time, the suction force by the suction device disturbs an air space where the ink jet heads are located via the suction holes located in gaps between adjacent cardboard sheets. Thus, by providing the upstream and downstream sides of each of ink jet heads including ink jet nozzles therein with skirts, respectively, and by extending these skirts over the entire width of the cardboard sheets, a space between the ink jet heads and the cardboard sheets is partitioned.

By means of such simple members, the deviation of positions where the ink droplets land on the surface from the desired positions can be limited within an acceptable range, which deviation is caused by the deflection of the trajectory of the ink droplets during their flight between the tip of the ink jet nozzles and the sheet derived from the disturbance of the air space between the ink jet nozzle and the sheet, whereby clear printing images can be obtained by forming the dots on the surface of the desired position by the ink jet printing.

In another embodiment of the printing machine according to the present invention, each of said ink jet heads has a rectangular cross-section, one of the skirts being fixed on the upstream surface of each of said ink jet heads in the transferring direction, the other of the skirts being fixed on the downstream surface of each of said ink jet heads in the transferring direction, wherein a distance between the tips of the said skirts and said the other surface is adjustable depending on the suction force of the suction device and/or a distance between said ink jet nozzles and said the other surface.

In still another embodiment of the printing machine according to the present invention, said suction device has a suction box in fluid communication with said suction holes located opposite to the cardboard sheets with respect to the conveyor, and wherein the width of the suction box is adjustable depending on the width of the cardboard sheets; said skirts having flexibility so as not to scratch said the other surface when the tips of said skirts contacts said the other surface of the cardboard sheets being transferred.

In still another embodiment of the printing machine according to the present invention, said ink jet heads have a plurality of rows of heads which heads are spaced apart from each other in the width direction of the cardboard sheets, said plurality of rows of heads are spaced apart from each other so as to cover the entire width of the cardboard sheets; respective heads of said plurality of rows of heads further having skirts extending toward said the other surface and in the transferring direction so as to form a partition in a space between said ink jet nozzles and said the other surface.

In still another embodiment of the printing machine according to the present invention, the printing machine further comprises a support plate for supporting said ink jet heads; said support plate having an opening large enough to enclose said ink jet nozzles in said ink jet heads at the location where the ink jet heads are provided; said opening extending downwardly toward said the other surface and said skirts being provided along an entire periphery of the opening.

A printing machine in accordance with the present invention will now be disclosed below with reference to the accompanying drawings in which

DETAILED DESCRIPTION OF THE PREFERRED EMBODIMENT(S) OF THE INVENTION

Figure 1:
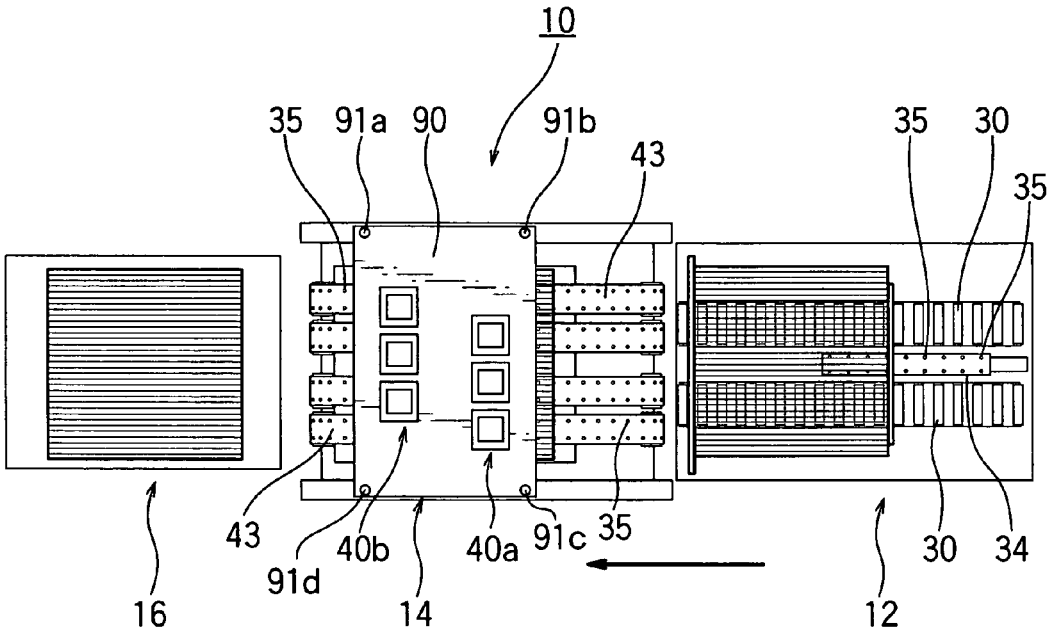
FIG. 1 is a plan view showing Sprinting machine in accordance with the present invention.
Figure 2:
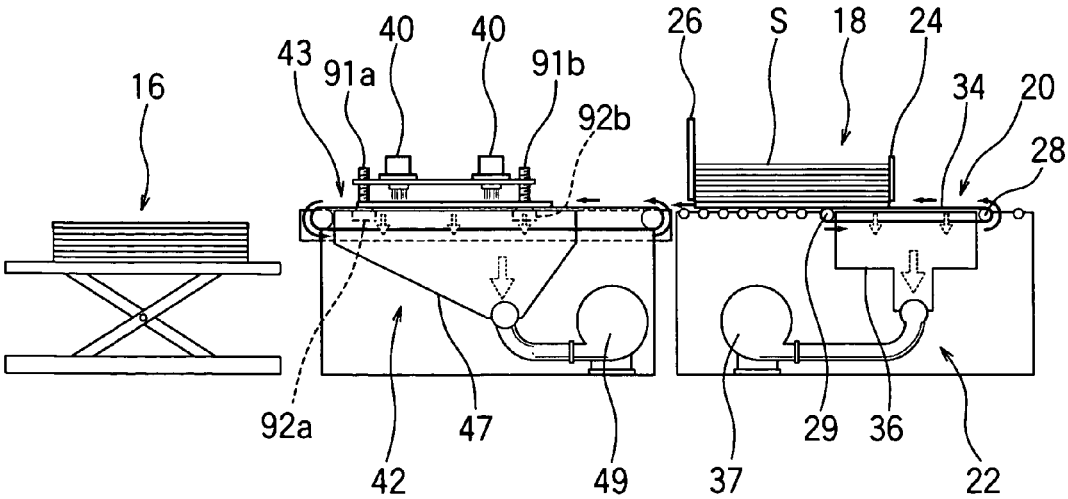
FIG. 2 is a side view showing a printing machine in accordance with the present invention.

As can be seen in FIGS. 1 and 2, the printing machine 10 includes a feeding unit 12, a printing unit 14 and a stacking unit 16, and these units are aligned with respect to each other, as shown by an arrow.

The feeding unit 12 feeds cardboard sheets which are made in an upstream step of a manufacturing line, to the printing unit 14 which includes a hopper 18 for stacking the sheets, a conveyor 20 for transferring the sheets to the printing unit 14, and a suction device 22 for sucking the sheet onto the conveyor 20. The hopper 18 includes a back stop 24 located upstream in the feeding direction, and a front stop 26 located downstream and movable upwardly and downwardly, so as to stack each sheet therebetween. A gap is provided at the bottom of the front stop 26 in such a manner that the gap is larger than a thickness of the sheet and smaller than that of double stacked sheets. According to such an arrangement described above, stacked sheets can be transferred one by one to the printing unit 14 via the conveyor 20. The conveyor 20 has a pair of rollers consisting of one driving roller 28 and one idle roller 29 and an endless belt 34 disposed between the pair of rollers. The conveyor 20 is located between a pair of idle rollers 30, and the sheet is guided by the belt 34, whereby it is transferred to the printing unit 14. The belt 34 includes a number of suction holes 35 formed therethrough, when a sheet is disposed on the belt 34 with the sheet covering the suction holes 35, the sheet is sucked onto the belt 34 via the suction device 22, whereby unwanted shift of the sheet on the belt 34 is prevented. In the suction device 22 described above, the suction device 22 is located below the belt 34 and includes a suction box 36 extending in the feeding direction of the sheet and a fan 37 for sucking an air out.

The printing unit 14 includes ink jet heads 40 located above the sheet, an ink-jet control device (see FIG. 6), a suction device 42 located below the sheet, and a conveyor 43 constructed in the same way as that of the feeding unit 12. In the ink jet heads 40, there are two sets of heads, i.e., a first set of ink jet heads 40*a* and a second set of ink jet heads 40*b*. Each of the ink jet heads includes a plurality of ink jet nozzles 44. The ink jet heads of the first and second sets of ink jet heads 40*a*, 40*b* are aligned with each other in the width direction of the sheet which is perpendicular to the feeding direction so as to cover the entire width of the sheet. Any number of heads 40 can be selected depending on the size of the sheet, however, in this embodiment, the first and second sets of the ink jet heads 40*a* and 40*b* have three heads, respectively, for a total of six.

Figure 7:
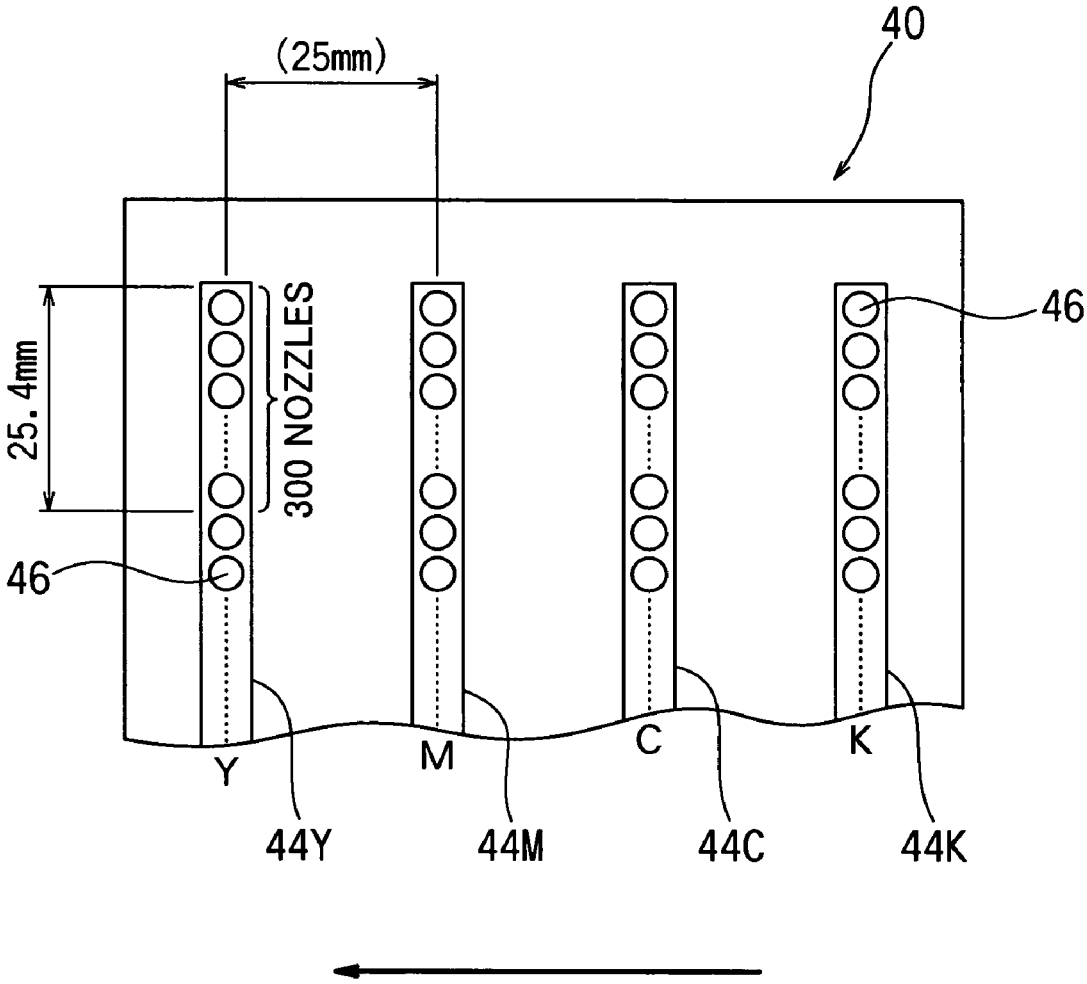
FIG. 7 is a partial plan view showing the arrangement of the ink jet nozzles.

As can be seen in FIG. 7, each of the ink jet heads 40 has four groups of ink jet nozzles 44Y, 44M, 44C and 44K which respectively correspond to the colors YMCK, i.e., yellow, magenta, cyan and black. Each group includes a plurality of ink jet nozzles spaced apart, for example, 84 microns with respect to each other in the widthwise direction, and consisting of four units each unit having three hundred such nozzles. These four groups of nozzles 44Y, 44M, 44C and 44K are located in the order of YMCK from the downstream to the upstream of the sheet with being spaced apart 25 m from each other in the feeding direction. According to such an arrangement of the ink jet nozzles 44, there is provided a printing image having a 300 dpi (density per inch) resolutions on the sheet. In the embodiment as described above, the preferable dpi resolution of the printing is from 300 dpi to 900 dpi in order to obtain clear images with a high efficiency, so the arrangement of the nozzles can be altered due to the specific application.

More specifically, the arrangement of dots in the widthwise direction formed on the sheet by the ink droplets jetted out from the same ink jet nozzle is closely associated with the widthwise arrangement of the ink jet nozzles. In other words, the pitch between adjacent dots on the sheet is determined by gaps in the widthwise direction between the adjacent ink jet nozzles. In this case, 300 dpi of dots are formed in the widthwise direction due to the above-described arrangement of the ink jet nozzles. While on the other hand, the arrangement of dots in the feeding direction is determined by the value which is calculated by multiplying a summation of a time period for the ink droplets to travel between the ink jet nozzle and the surface of the sheet and that for the bubble to be generated in the ink jet nozzle by the velocity at which the sheet is transferred. The traveling time period and the bubble forming time period are totally dependent on the capability of the thermal type ink jet printing technique.

In view of the printing finish, dpi of dots in the widthwise direction is normally set to be identical to that in the feeding direction. Accordingly, the feeding velocity of the sheet may be determined so as to make the dpi in the feeding direction match that in the widthwise direction which is determined by the widthwise arrangement of the ink jet nozzles.

Therefore, when the sheet is being fed, the entire width of the sheet is covered by all the ink jet heads 40*a*, 40*b* and the ink jet nozzles 44 of the ink jet heads 40 are controlled by the ink-jet control device 41 to create printing image by the ink droplets.

More particularly, each of the ink jet nozzles 44 is caused to eject the ink supplied by respective ink reservoirs 45 (see FIG. 6) from openings 46 onto the surface S of the sheet. To this end, an electrical potential is applied at the bottom of the ink jet nozzles 44 to cause heated bubbles to be formed in the ink jet nozzles 44 to cause the ink droplets to be emitted from the tip thereof.

The construction of the suction device 42 and the transfer conveyor 43 is similar to that of the feeding unit 12, as can be seen in FIGS. 1 and 2. The suction device 42 includes a suction box 47 and a fan 49 disposed below the conveyor 43. The transfer conveyor 43 includes four rows of conveyors spaced apart from each other in the widthwise direction, each of which has the suction holes 35 for applying a suction force to the sheet moving toward the printing unit 14. Also, the suction air by the suction device 42 will flow from the lower side of the sheet to the upper side of the sheet through the holes 35 located in the gap between the adjacent sheets in the feeding direction and thus to a space 53 between the ink jet heads 40 and the surface S of the transferred sheet. This causes the ink droplets emitted from the ink jet nozzles 44 toward the surface of the sheet to be deflected. The suction force is preferably from 1 kPa to 5 kPa.

Figure 9:
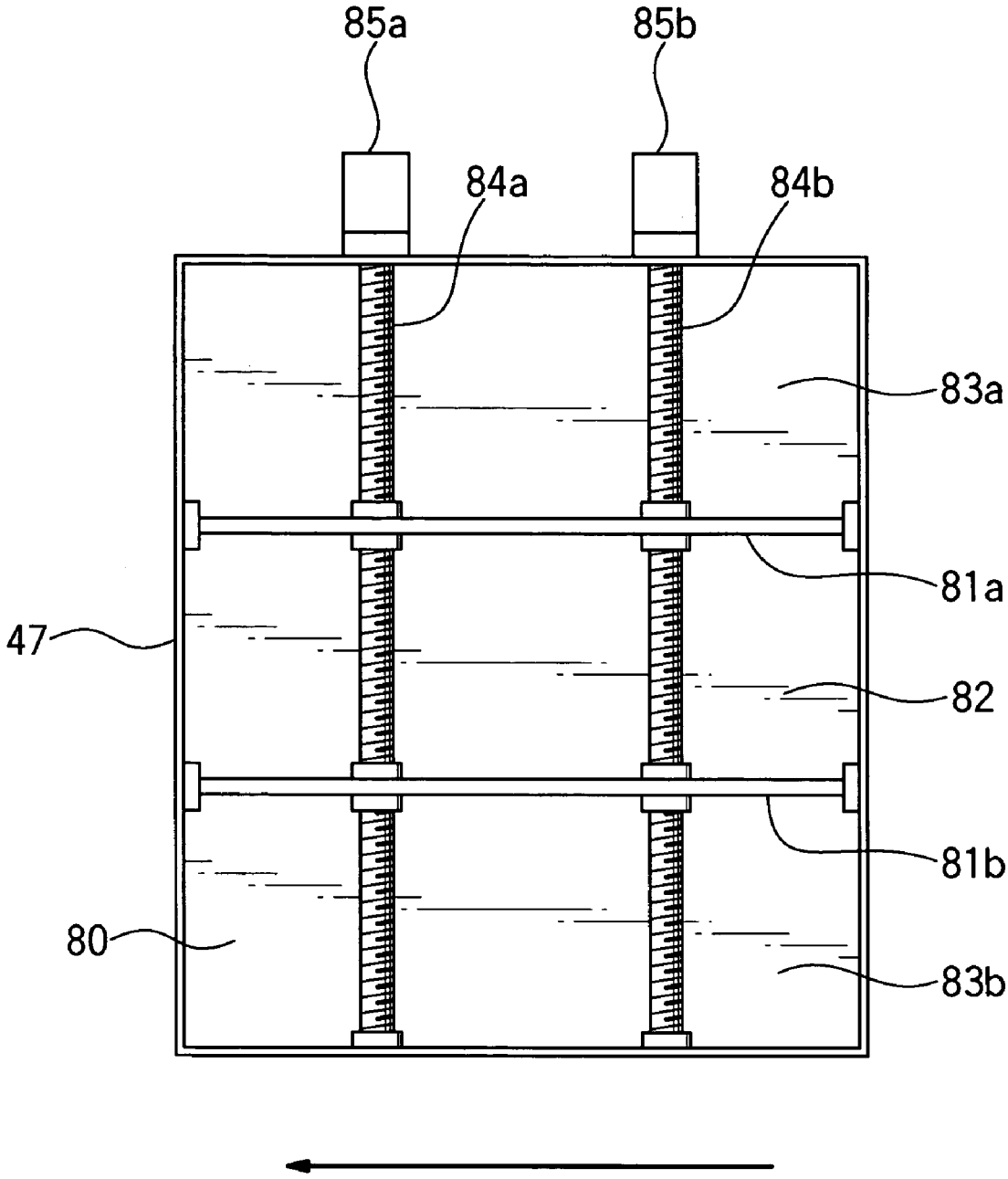
FIG. 9 is a plan view showing the inner part of the suction box of the printing machine.

As can be seen in FIGS. 1 and 2, the suction box 47 has a width large enough to cover all the suction holes 35 and a length longer than the sheet, and has a rectangular opening facing the conveyor 43. As shown in FIG. 9, provided within the suction box 47 are a pair of dampers 81*a*, 81*b* each extending in the feeding direction of the sheet, as shown by an arrow, which creates a separated suction area 82 and non-suction areas 83*a* and 83*b*. The pair of dampers 81*a*, 81*b* are supported by a pair of threaded shafts 84*a* and 84*b*, respectively, which are rotated by damper adjusting motors 85*a* and 85*b* so as to move the dampers 81*a*, 81*b* in the width direction whereby the width of the suction area 82 can be adjusted in accordance with the width of the sheet.

Figure 3:
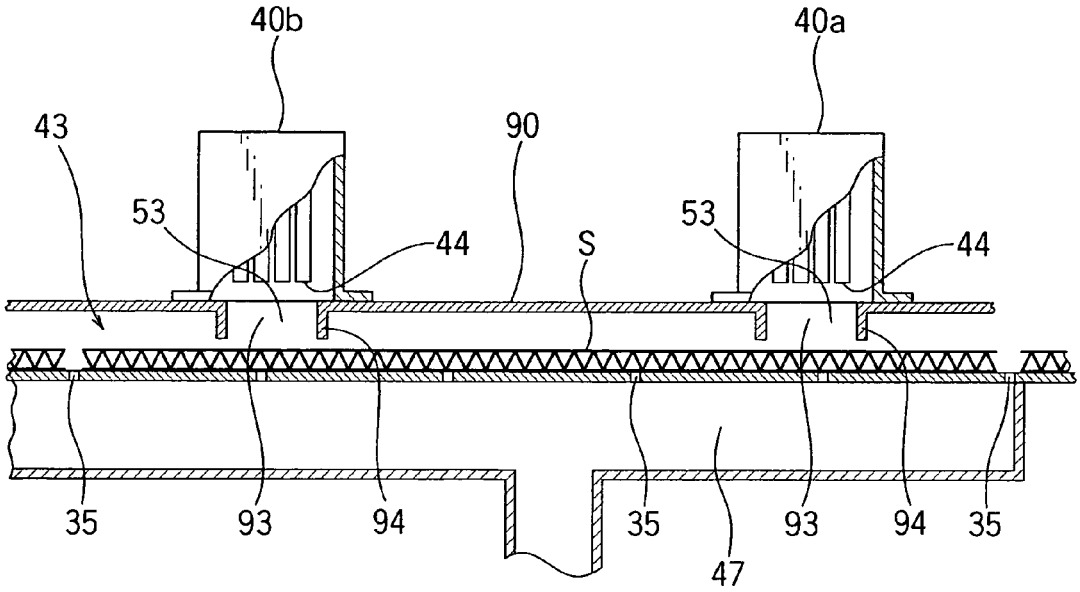
FIG. 3 is an enlarged cross-sectional view showing supporting portion for the ink jet heads.
Figure 4:
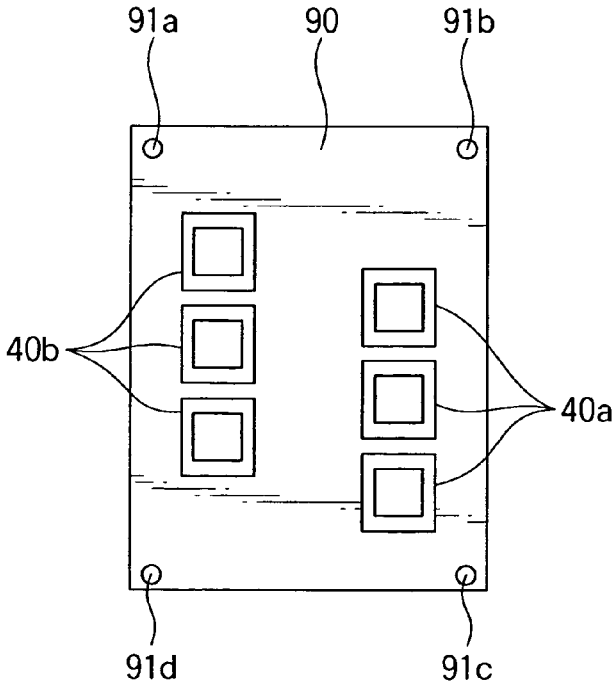
FIG. 4 is a plan view showing the support plate of the printing machine.
Figure 5:
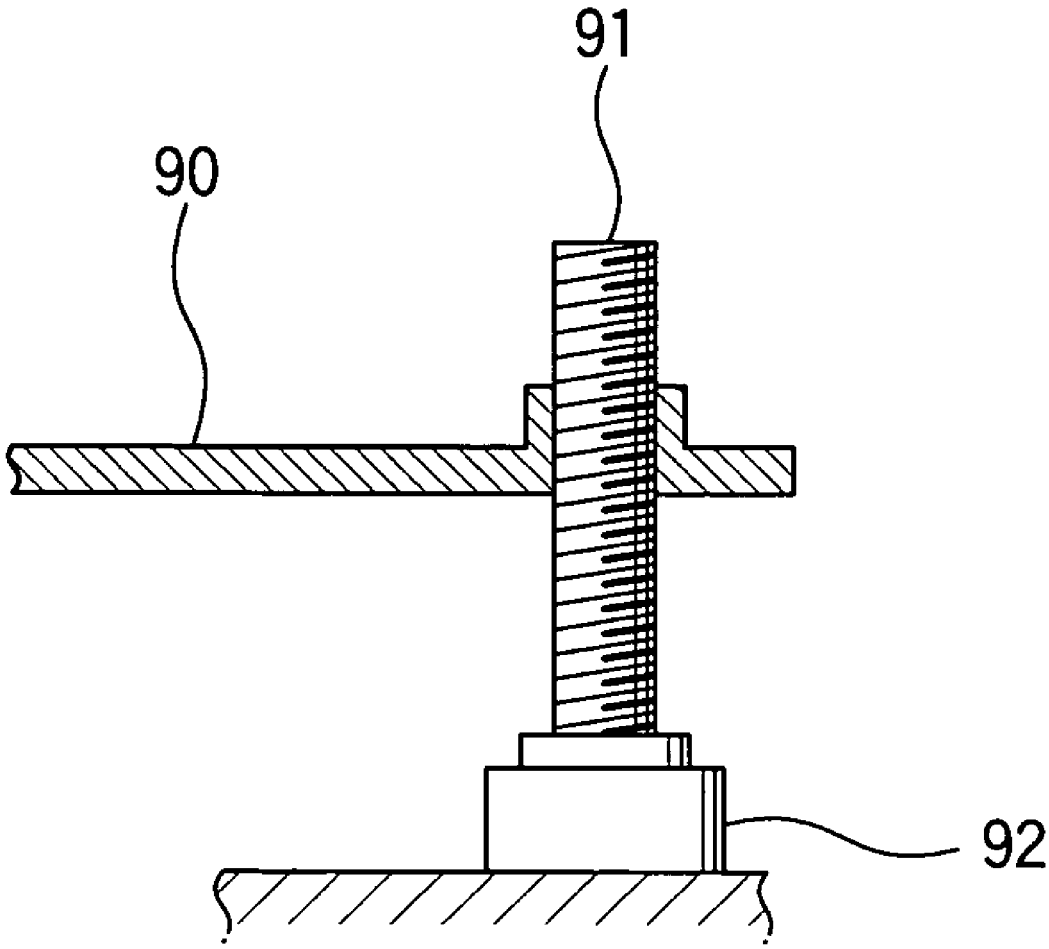
FIG. 5 is a partial section view showing the corner portion of the support plate of the printing machine.

As can be seen in FIG. 3, a support plate 90 is disposed above and parallel to the conveyor 43 for supporting the ink jet heads 40. The support plate 90 has a size large enough to mount the ink jet heads 40 thereon, and is supported by four threaded shafts 91*a*, 91*b*, 91*c* and 91*d*, as shown in FIG. 4. More particularly, as can be seen in FIG. 5, the threaded shafts 91*a*, 91*b*, 91*c* and 91*d* are connected to motors 92*a*, 92*b*, 92*c* and 92*d* at each of corners of the support plate 90, respectively. By driving the motors 92 in a synchronized fashion, the threaded shafts 91 are caused to rotate, whereby the support plate 90 is moved up and down while it is kept parallel to the conveyor belt. Rectangular openings 93 are formed in the support plate 90 at locations corresponding to the ink jet heads 40. Each of the rectangular openings 93 has a size large enough to enclose the ink jet nozzles 44 in the corresponding ink jet head. Therefore, the ink emitted from the ink jet nozzles 44 goes through the rectangle openings 93 and lands on the surface of the sheet. Formed around the rectangular openings 93 are skirts 94 extending toward below. More specifically, the skirts 94 are mounted on the upstream, downstream and two lateral sides of the rectangular opening 93, respectively. The height of the skirts 94 is decided that they do not to come into contact with the sheet surface when the height of the support plate 90 is adjusted by the motor 92 to the minimum distance therebetween. Thus, the distance between the tip of the ink jet nozzles 44 and surface of the sheet can be adjusted in a case where the thickness of the sheet to be printed is changed. Alternatively, by adjusting the distance between the lower end of the skirts 94 and the surface of the sheet in accordance with the suction force by the suction unit, the degree of how the space around the rectangular openings 93 being partitioned by the skirts 94 can be adjusted so as to modify how much the ink droplets jetted out from the ink jet nozzles 44 are deflected during their travel by the suction air.

The skirts 94 can be integrally made from the support plate 90 by folding its edges, or can be made of a flexible material such as TEFRON®. Thus, even when the tips of the skirts 94 come into contact with the printing surface, the printing surface can be protected from being scratched.

Figure 6:
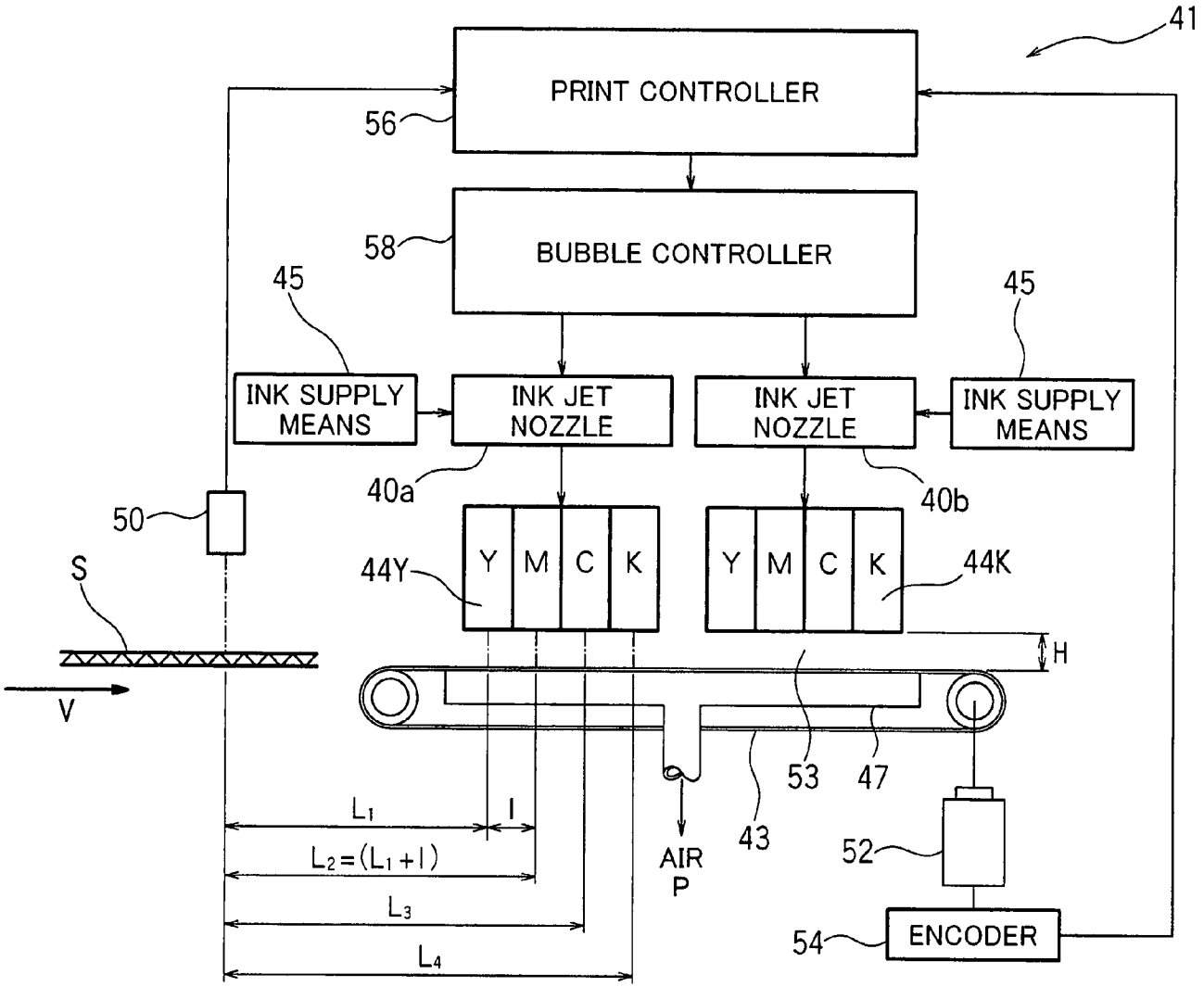
FIG. 6 is a schematic diagram showing a control device of the printing machine.

As can be seen in FIG. 6, the ink-jet control device includes a sheet position sensor 50, an encoder 54 mounted on a conveyor drive shaft 52, a processor 56 which receives signals from the sheet position sensor 50 and the encoder 54, and a bubble control device 58 which receives signals from the processor 56 and transmits signals to the ink jet nozzles.

The operation of the above described printing machine 10 will be explained below.

Firstly, the rotation of the motor 92 is adjusted in accordance with the thickness of the sheet, whereby the distance H between the tips of the ink jet nozzles 44 and the printing surface is adjusted, for example, from 1.0 m to 1.5 m. Next, the rotation of the motor 85 is adjusted in accordance with the width of the sheet, whereby the location of the dampers 81*a*, 81*b* and thus the width of the suction area 82 are adjusted in such a way that the entire width of the sheet can be sucked.

Also, data of feeding distances L1, L2, L3 and L4 regarding distances from the sheet position sensor 50 to the ink jet heads 40 and data of sheet feeding speed V are stored in the processor 56. When the sheet is fed one by one from the feeding unit 12 to the printing unit 14, the lower surface of the sheet is suctioned by the suction device 22, whereby the warp of the sheet is removed, and then the sheet goes through immediately below the ink jet heads 40 without causing the shift of the sheet relative to the conveyor belt. When the sheet passes through the sheet position sensor 50, a detection signal is transmitted to the processor 56. When the sheet position sensor 50 detects the front end of the sheet which is being transferred, the detecting signal is transmitted to the processor 56. At the same time, the encoder 54 starts counting the rotations of the motor 42, and a rotation count signal is transmitted to the processor 56. The processor 56 converts the rotation count signal to the distance data using the sheet feeding speed data, and when the converted distance data matches the predetermined data, transmits a signal to the bubble control device 58. The bubble control device 58 transmits a control signal to the ink jet heads 40 so as to cause the ink to be jetted out from the nozzles 44 toward the surface S of the sheet, thereby causing the ink to land on the surface S to form a number of dots on the surface S, whereby the printing image with the desired colors and shape is created with YMCK color dots.

More particularly, a desired voltage potential is applied in accordance with a so-called thermal method in the ink jet printing, whereby bubbles having a desired volume can be created, and thus the ink droplets with predetermined volumes are emitted from the tips of the nozzles 44 and go through the rectangular openings 93 and land on the sheet. At this time, some of the suction air is released through the suction holes 35 not covered by the sheet, and suction air also flows through the space between the ink jet nozzles 44 and the printing surface to a space above the sheet. At this time, the skirts 94 located on upstream and downstream of the rectangular openings 93 reduce the effect of the suction air going through the suction holes 35 located the gap portion between adjacent sheets in the feeding direction, while the skirts 94 located on either lateral sides of the rectangular openings 93 reduces the effect of the suction air going through the suction holes 35 located on an area beyond the width of the sheet. Therefore, just by adding such simple members, a trajectory of the ink droplets between the ink jet heads 40 and the printing surface can be stably maintained, whereby the deviation of the position where the ink droplets lands on the sheet can be limited within the acceptable range, and as a result, dots can be created on a desired position on the sheet to attain an ink jet printing.

Figure 8:
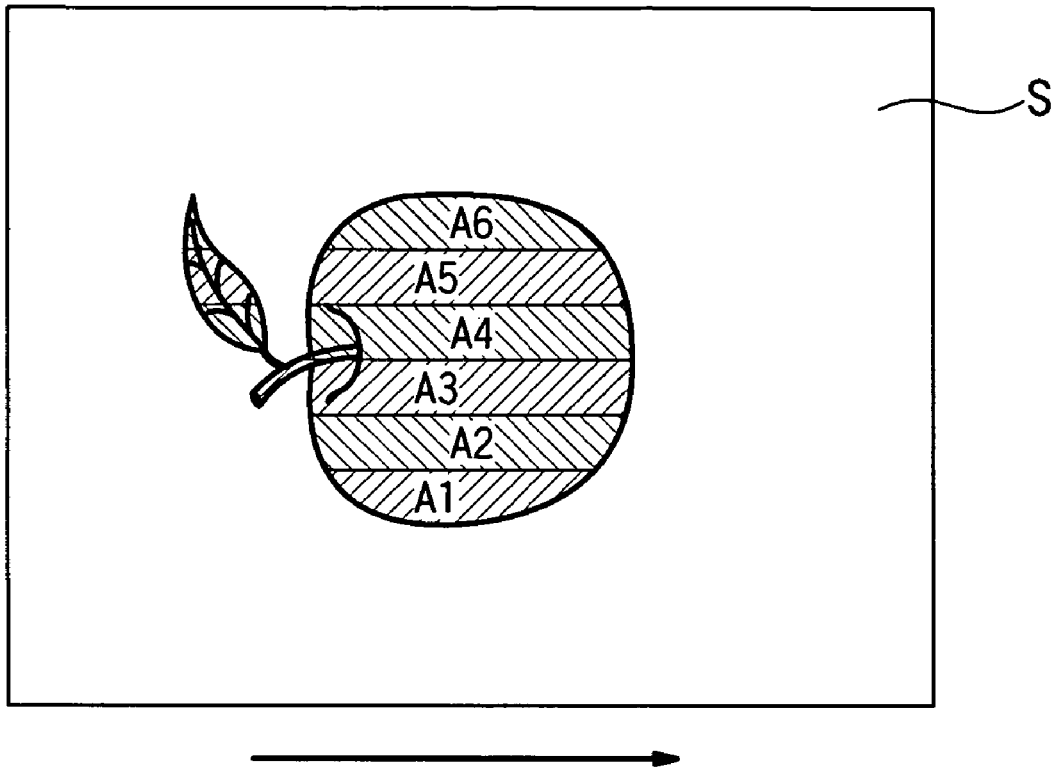
FIG. 8 is a picture explaining the image printed on the cardboard sheets.

The printing operation described above is carried out for the first set of ink jet heads 40*a* and the second set of ink jet heads 40*b*. More particularly, the printing areas A2, A4 and A6 are printed via the first set of ink jet heads 40*a*, and thereafter the printing areas A1, A3 and A5 are printed via the second set of ink jet heads 40*b*. FIG. 8 shows an example of a printed image.

The printed sheet is transferred to the stacking unit 16 and stacked therein. The printing operation of the printing machine is now completed.

The above described embodiment can be modified within the spirit and scope of the invention, which those skilled in the art will recognize. For example, in the embodiment disclosed above, a plurality of ink jet heads 40 each having respective skirts 94 are provided. However, in an alternative embodiment, only one ink jet head 40 can be provided for covering a constant width of a sheet, in which case by adjusting the position of the dampers 81*a*, 81*b*, the provision of the skirts 94 on either sides of the rectangular openings 93 extending in the feeding direction can be omitted.

Also, the present invention can be applied not only to a flat sheet but also a corrugated sheet. In such a case, the printed corrugated sheet having a high quality printing image on the surface can be utilized as a package for foods, furniture, etc.

What is claimed is:

1. A printing machine comprising:

a transfer device including a conveyor having suction holes formed therethrough for transferring cardboard sheets one by one;

a suction device for applying a suction force on one of the two surfaces of each of the cardboard sheets, which one of two surfaces faces said conveyor; and ink jet heads located to face the other of the two surfaces of each of the cardboard sheets and be spaced apart therefrom;

wherein said ink jet heads are located in such a manner that a desired distance is maintained between tips of the ink jet heads and said the other surface to be printed, and said ink jet heads, extending in a width direction of said cardboard sheet, include ink jet nozzles from each of which ink droplets are jetted out toward said the other surface;

said ink jet heads further including skirts, located upstream and downstream in a transferring direction of the cardboard sheets, for preventing the ink droplets from deflecting in an air space between the ink jet nozzle and the other surface of the cardboard sheet by a component of the suction force applied in the transferring direction, said skirts being provided in such a manner that said skirts extend from said ink jet heads toward said the other surface and have a width, extending in the width direction of the cardboard sheet, so as to form a partition in the air space between said ink jet nozzles and said the other surface of the cardboard.

2. The printing machine as recited in claim 1, wherein each of said ink jet heads has a rectangular cross-section, one of the skirts being fixed on the upstream surface of each of said ink jet heads in the transferring direction, the other of the skirts being fixed on the downstream surface of each of said ink jet heads in the transferring direction, said printing machine further comprising means for adjusting a distance between the tips of the said skirts and said the other surface depending on the suction force of the suction device and/or a distance between said ink jet nozzles and said the other surface.

3. The printing machine as recited in claim 2 wherein said suction device has a suction box in fluid communication with said suction holes located opposite to the cardboard sheets with respect to the conveyor, and wherein said adjusting means adjusts the width of the suction box depending on the width of the cardboard sheets;

said skirts having flexibility so as not to scratch said the other surface when the tips of said skirts contacts said the other surface of the cardboard sheets being transferred.

4. The printing machine as recited in claim 1 wherein said ink jet heads have a plurality of rows of heads which heads are spaced apart from each other in the width direction of the cardboard sheets, said plurality of rows of heads are spaced apart from each other so as to cover the entire width of the cardboard sheets respective heads of said plurality of rows of heads further having skirts extending toward said the other surface and in the transferring direction so as to form a partition in a space between said ink jet nozzles and said the other surface.

5. The printing machine as recited in claim 1 further comprising:

a support plate for supporting said ink jet heads;

said support plate having an opening large enough to enclose said ink jet nozzles in said ink jet heads at the location where the ink jet heads are provided;

said opening extending downwardly toward said the other surface and said skirts being provided along an entire periphery of the opening.

* * * * *

UNITED STATES PATENT AND TRADEMARK OFFICE

CERTIFICATE OF CORRECTION

PATENT NO. : 7,731,349 B2
APPLICATION NO. : 11/447798
DATED : June 8, 2010
INVENTOR(S) : Kazuhiro Hatasa et al.

It is certified that error appears in the above-identified patent and that said Letters Patent is hereby corrected as shown below:

In column 8, claim 4, line 33, immediately after "cardboard sheets" insert --;--.

Signed and Sealed this

Twenty-third Day of November, 2010

David J. Kappos

David J. Kappos
*Director of the United States Patent and Trademark Office*